US010000982B2

(12) United States Patent
Back

(10) Patent No.: US 10,000,982 B2
(45) Date of Patent: Jun. 19, 2018

(54) RELEASE VALVE USED IN AN INNER TUBE ASSEMBLY FOR USE WITH A CORE BARREL

(71) Applicant: SANDVIK INTELLECTUAL PROPERTY AB, Sandviken (SE)

(72) Inventor: Goran Back, Nora (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 381 days.

(21) Appl. No.: 14/771,796

(22) PCT Filed: Feb. 11, 2014

(86) PCT No.: PCT/EP2014/052630
§ 371 (c)(1),
(2) Date: Aug. 31, 2015

(87) PCT Pub. No.: WO2014/131613
PCT Pub. Date: Sep. 4, 2014

(65) Prior Publication Data

US 2016/0017677 A1 Jan. 21, 2016

(30) Foreign Application Priority Data

Mar. 1, 2013 (AU) ..... 2013900701

(51) Int. Cl.

| | |
|---|---|
| ***E21B 21/10*** | (2006.01) |
| ***E21B 25/02*** | (2006.01) |
| ***E21B 47/09*** | (2012.01) |
| ***E21B 23/00*** | (2006.01) |
| ***E21B 34/10*** | (2006.01) |

(52) U.S. Cl.
CPC ..... *E21B 21/103* (2013.01); *E21B 21/10* (2013.01); *E21B 23/00* (2013.01); *E21B 23/006* (2013.01); *E21B 25/02* (2013.01); *E21B 34/10* (2013.01); *E21B 47/091* (2013.01)

(58) Field of Classification Search
CPC ..... E21B 21/10; E21B 21/103; E21B 23/006; E21B 25/02; E21B 34/10; E21B 23/00; E21B 47/091
See application file for complete search history.

(56) References Cited

U.S. PATENT DOCUMENTS

| | | | | |
|---|---|---|---|---|
| 5,169,183 | A | 12/1992 | Hallez | |
| 5,799,742 | A * | 9/1998 | Soinski | E21B 21/10 175/236 |
| 9,644,439 | B2 * | 5/2017 | Lambert | E21B 25/02 |
| 2014/0353039 | A1 * | 12/2014 | Lambert | E21B 25/02 175/57 |
| 2015/0014065 | A1 * | 1/2015 | Lambert | E21B 25/02 175/317 |

FOREIGN PATENT DOCUMENTS

| | | | | |
|---|---|---|---|---|
| WO | WO-2013110159 | A1 * | 8/2013 | E21B 25/02 |

* cited by examiner

*Primary Examiner* — Nicole Coy
(74) *Attorney, Agent, or Firm* — Corinne R. Gorski

(57) ABSTRACT

An inner tube assembly releasably latchable with a core barrel of a core drilling apparatus. The inner tube assembly includes a valve housing having a fluid flow port and a position guide to control a position of the valve body within the valve housing to open and close the port in response to a fluid pressure acting on the valve body.

11 Claims, 12 Drawing Sheets

RELEASE VALVE USED IN AN INNER TUBE ASSEMBLY FOR USE WITH A CORE BARREL

RELATED APPLICATION DATA

This application is a § 371 National Stage Application of PCT International Application No. PCT/EP2014/052630 filed Feb. 11, 2014 claiming priority of AU Application No. 2013900701, filed Mar. 1, 2013

FIELD OF INVENTION

The present invention relates to core drilling and in particular although not exclusively to apparatus and methods for the delivery and removal of an inner tube assembly within a core drilling string or apparatus.

BACKGROUND ART

Diamond core drilling utilises an annular drill bit connected to a core barrel assembly. The core barrel is attached to the end of a number of tubular drill rods connected to form a drill string. The drilling progressively removes cylindrical cores of rock or material through which the drill and drill tube advance using a sequence of runs. This type of drilling utilises an inner tube assembly which has an inner tube connected to a head assembly to receive the core sample. The head assembly comprises a latch body connected to a valve housing which in turn is connected to a bearing housing which in turn is connected to an inner tube connector. The inner tube assembly connects to the inner tube connector and may comprise an inner tube, core lifter and core lift case. The inner tube assembly locates within a core barrel which comprises a combination of drill bit, reamer, outer tube, landing ring and locking coupling. The inner tube assembly can be retrieved from the surface when the inner tube is full. Empty inner tube assemblies can be delivered from the surface to the bottom of the drill string in order to recommence drilling.

The drill bit is advanced by rotating the drill string while applying downward pressure. In addition, drilling fluid such as water or drilling muds are pumped through the centre of the drill string, past the inner tube assembly and through the end of the drill bit in order to carry cuttings and other drilling debris to the surface via the annulus between the wall of the hole and the external surface of the drill string.

The hole being drilled may range from vertical, angled downwardly, horizontal, inclined upwardly or directly upwardly. The holes being drilled may be either normal or dry. In dry holes, the drilling fluid drains away or partially drains away naturally through crevasses or other openings in the rock strata through which the drill passes. In normal holes, the drilling fluid does not drain away. Hereafter, normal holes, which retain water or partially retain water will be referred to as wet holes.

Of course, in the case of horizontal or near horizontal holes, it is likely that drilling fluid would naturally drain away particularly when the inner tube assembly is being retrieved or after the inner tube assembly is pumped back into the end of the drill string.

One practice in inserting an empty inner tube assembly from the surface back into the drilling end of the drill string, to use fluid pumped in behind the inner tube assembly to push it along the drill tube into the core barrel and into its drilling position. An empty inner tube assembly is placed into the drill tube at the surface and a water swivel is screwed into the end of the drill tube which allows for fluid to be pumped into the drill tube. This pushes the inner tube assembly to the end of the drill tube where it latches in place in its drilling position in the core barrel prior to recommencing the drilling operation.

Once the inner tube assembly is latched in place, an increase in pressure of the fluid being pumped will result and is sensed and provides the indication that the inner tube assembly has been pumped into its drilling position and is latched. In order to achieve this and in order to allow the inner tube assembly to pump into its latched position, fluid must be prevented from passing through the inner tube assembly. Also, once the inner tube assembly reaches its latched position, it is a requirement that fluid be allowed to pass through the inner tube assembly as part of the drilling process to flush away cuttings.

In order to achieve both of these functions, a release valve is installed within the inner tube assembly to control fluid movement during the various phases of pumping in and drilling.

Accordingly, as the inner tube assembly is being pumped into position, the release valve is in a first position that closes fluid flow ports that would otherwise allow the fluid to flow past the inner tube assembly. Upon the inner tube assembly reaching the core barrel and drilling position, the release valve will be maintained in a closed position which then results in a pressure spike which gives the operator at the surface an indication that the inner tube assembly has reached its latched position.

This increase in pressure may or may not be maintained up until the operator opens a valve to release the pressure. The release valve is arranged so that is will move to a second position itself or upon release of the pump in fluid pressure where the fluid flow ports within the inner tube assembly are open so that the latched inner tube assembly is ready for drilling. In this position, the fluid flow ports are now open and the drilling fluid is able to pass through the inner tube assembly to perform normal drilling operations.

However, prior to commencement of drilling and pumping of the drilling fluid through the drill tube, fluid within the drill tube and the drilled hole is free to drain away from the hole. This is particularly the case in relation to a dry hole where fluid is able to naturally drain within the rock strata or in relation to holes which are horizontal or inclined upwardly.

Clearly, this is undesirable as the drilling operation is delayed while additional fluid is being pumped into the drill string in order to commence the drilling operation. It also requires a skilled operator to know when fluid is present at the drill bit so that the drilling is not commenced without the necessary lubrication, cooling and debris clearance that the drilling fluid provides. If the drill bit is run without the drilling fluid being present, then damage can occur to the drill bit.

It is against this background and the problems referred to above which has resulted in the development of the present invention.

Certain objects and advantages of the present invention will become apparent from the following description, taken in connection with the accompanying drawings, wherein by way of illustration and example, an embodiment of the present invention is disclosed.

SUMMARY OF THE INVENTION

It is an objective of the present invention to provide an inner tube assembly in which a valve part of the assembly is controllable and responsive to a fluid pressure supplied through the core barrel to the inner tube assembly in order to open and close the valve during for example installation of the inner tube assembly within the core barrel and when operating in a core drilling mode.

The objectives are achieved by providing an inner tube assembly that is capable of being transported to a latched position within the core barrel via a working fluid and to preserve a column of working fluid behind the inner tube assembly before, during and upon latching of the assembly at the core barrel. In particular, the valve of the present assembly is configured to be sensitive to the fluid pressure of the working fluid at the trailing end of the assembly. Additionally, a further advantage for the subject invention is to provide a valve arrangement that is sensitive to the 'state' of an inner tube that may be either empty or filled with a core sample ready for retrievable rearwardly through the hole.

According to a first aspect of the present invention there is provided an inner tube assembly releasably latchable within a core barrel of a core drilling apparatus, the inner tube assembly comprising: a valve housing having a first leading end and a second trailing end, the housing defining an internal bore extending axially in a direction between the first and second ends; at least one fluid flow port provided through the valve housing to allow fluid communication with a region surrounding the valve housing and the bore; a valve body axially slidable within the bore to open and close the port; a bias member acting on the valve body to bias the valve body in a first axial direction within the bore; and a position guide to guide and control a position of the valve body within the bore relative to the port; wherein the valve body is configured for movement in a second return axial direction within the bore to open and close the port by a fluid pressure acting on the valve body via the second end of the housing.

Optionally, the assembly further comprises a valve pin mounted to be capable of axial movement within the bore to contact the valve body, the bias member configured to bias the pin into contact with the valve body. The valve pin in combination with the bias member is operative to provide the valve body in a floating position within the bore so as to be sensitive to the pressure of fluid received within the bore from the open surface end of the drill hole.

Preferably, the position guide comprises a slot provided in the housing and a guide pin extending radially from the valve body to be movable within the slot. The slot and guide pin arrangement is advantageous to provide a reliable and robust latching mechanism of the valve body whilst minimising the radial dimensions of the assembly. Preferably, the slot comprises a length having an angled section, the guide pin capable of moving along the length and passed the angle section. More preferably, the angled section comprises a v-shaped profile. Such an arrangement is advantageous to provide control of the relative position of the guide pin within the slot and to journal the pin to be, in part, resistant to travel in a circumferential direction so as to provide a partial notched latch arrangement.

Preferably, the assembly further comprises a bearing assembly coupled to the first end of the valve housing, at least a part of the bearing assembly being movable axially relative to the valve housing to close and open the port. The bearing assembly acts to impart an axial force to the valve body such that the valve body is sensitive to open and close the port in response to a force provided on the valve assembly by the bearing assembly.

Preferably, the apparatus further comprises an elongate spindle extending axially between the valve housing and the bearing assembly, the bearing assembly further comprising a bearing housing extending axially over the spindle. Optionally, the spindle is configured to move axially within the bore to contact and force the valve body to move in the first axial direction to open and close the port. Such an arrangement is advantageous to provide a mechanism for displacing the valve body to close the port when the inner tube is filled with a core sample and forward drilling is to be temporarily postponed to allow the core sample to be retrieved from the bore hole.

Optionally, the spindle is rigidly connected to the housing and the bearing housing is configured to slide axially relative to the valve housing to open and close the port at a radially external side of the port. Preferably, the assembly further comprises a bias component mounting the spindle within the bearing assembly to bias axial movement of the bearing housing or the spindle relative to the valve housing. Optionally, the assembly may further comprise a collar slidably mounted around a region of the valve housing in the vicinity of the port, the collar connected to the valve body via the guide pin and configured to open and close the port via abutment with the bearing housing.

Advantageously, the collar or the axial movement of the spindle provides the desired level of axial movement of the valve body in response to forces at the leading end of the assembly so as to change the valve between opened and closed states and to provide signal feedback to an operator via changes in pressure of the working fluid.

Preferably, the assembly further comprises a latch provided at or towards the second end of the valve housing to releasably latch the inner tube assembly in substantially fixed position within the core barrel. The latch is effective to grip the inward facing surface of the core barrel and to be engagable about additional components such as overshot assemblies and head retrieval components as are common to the art.

According to a second aspect of the present invention there is provided a method of controlling a flow of a working fluid within a drilling apparatus comprising: operating a valve within an inner tube assembly to maintain a fluid flow port of the assembly in a closed position to allow pressure of the fluid to push the inner tube assembly to a latched position within a core barrel of the drilling apparatus: i) while the pressure of the fluid is applied to push the inner tube assembly into the latched position; ii) when the inner tube assembly reaches the latched position; and iii) while the inner tube assembly is latched and a pressure of the fluid is released for a first time; applying a further pressure of the fluid to move the valve to an open position to allow the fluid to flow through the inner tube assembly during drilling operation.

Optionally, the method may further comprise forcing movement of a valve body within an internal bore of a valve housing by the application of a pressure of the fluid on the valve body via a second trailing end of the valve housing.

Optionally, the method may further comprise biasing the valve body to close the port by applying a pressure of the fluid that is less than the biasing force on the valve body i) while the inner tube assembly is pushed towards the latched position, ii) when the inner tube assembly reaches the latched position and iii) while the inner tube assembly is latched and a pressure of the fluid is released for the first time.

In a further aspect there is provided a release valve in an inner tube assembly, wherein the inner tube assembly is releasably latched within a core barrel having a drill bit and wherein fluid pressure is used to push the inner tube assembly to its latched position within the end of the core barrel, the release valve operating to maintain fluid flow ports within the inner tube assembly closed to thereby allow fluid pressure to push the inner tube assembly to its latched position (a) while the fluid pressure is applied to push the inner tube assembly into its latched position (b) when the inner tube assembly comes to a halt in its latched position and (c) while the inner tube assembly is latched and the fluid pressure is released for a first time, and wherein the release valve after the fluid pressure is released for the first time, operates upon a further application of fluid pressure to open the fluid flow ports to allow drilling operation by the drill bit of the core barrel.

Preferably, once the inner tube assembly reaches its latched position, the fluid flow ports within the inner tube assembly remain closed thereby preventing the column of fluid above the inner tube assembly from draining away. This will have significant advantages in the drilling operation in that minimal delays result between latching of the inner tube assembly and subsequently being able to recommence the drilling operation.

The release valve may comprise a valve body that is generally cylindrical and that is journalled within an axial bore within the inner tube assembly. The release valve body may move axially within this bore to open and close fluid flow ports. Fluid pressure may be used to move the valve body in one direction and force may be applied by resilient means (e.g., a spring) to move the valve body in the opposite direction upon release of fluid pressure.

The release valve may have position guide means that comprises a guide slot within the axial bore and a guide pin mounted on the release valve body. The location of the guide slot and pin may be reversed such that the guide slot is on the valve body instead.

The guide slot may be shaped to control the position of the valve body as the fluid pressure is applied and released. For example, the valve body may be set to a first position at the end of the guide slot wherein the resilient force applied to the valve body holds it in this position. The force provided by the resilient means is sufficient to hold it in this position while the inner tube assembly is being pumped into the core barrel to its latched and drilling position. Upon latching of the inner tube assembly and an increase in fluid pressure sufficient to overcome the predetermined force applied to by the resilient means, the valve body is caused to move and rotate as the guide pin on the valve body moves in the guide slot. The guide slot can be angled so that fluid pressure causes axial and rotational movement of the valve body to a second position where, maintaining the fluid pressure holds the valve body in a pre-set position. In both the first and second positions, the valve body is in a position such that the fluid flow ports are closed.

Upon release of the fluid pressure, the resilient means will apply sufficient force to the valve body to again axially move it to a third position. The guide slot is again angled to cause both axial and rotational movement of the valve body. Again, in this third position, the valve body closes the fluid flow ports to thereby prevent any draining of the fluid used to pump the inner tube assembly into its latched position.

From the third position, the guide slot is generally longitudinal so that application or removal of fluid pressure will only cause axial movement along the longitudinal axis of the axial bore. This axial movement from the third position to a fourth position results in the valve body moving from position where the fluid flow ports are closed to the fourth position where the fluid flow ports are open. Accordingly, with the valve body in the third position when fluid pressure is again applied, the valve body will move to an open position wherein normal drilling operation can commence. The fluid pressure applied will be sufficient to hold the valve body in the fourth open position while drilling proceeds.

In another aspect of the invention, when the inner tube becomes full or blocked at the drill bit face, the inner tube will act to move the release valve to a position where the fluid flow ports are closed. This increase in fluid pressure will be detected at the surface whereupon the operator will know that the inner tube is full or blocked. Upon this occurring, the operator will then perform a retrieval operation wherein an overshot tool is run or pumped into the drill tubing to attach to the inner tube assembly. The overshot tool acts to release the latch holding the inner tube assembly to the drill core barrel and to then retrieve the inner tube assembly to the surface.

Prior to sending in the overshot tool, the operator will lift the drill sting from the bottom of the hole. This acts to fracture the core sample adjacent the drill bit and also relieve the pressure of the full or blocked inner tube acting against the release valve. In this case, with the drill string off the bottom of the hole, the weight of the column of fluid within the drill string may be sufficient to push the release valve into a position where the fluid flow ports are open. When this occurs, then the fluid within the drill string will be free to drain away if in a hole where this will occur.

The overshot tool ordinarily has its own arrangement which will engage with the inner tube assembly to grasp it and at the same time to release the inner tube assembly latch from the core barrel. The overshot tool has a cable leading to the surface which is used to retrieve the inner tube assembly and overshot tool. This enables the core sample to be removed whereupon the cycle is repeated with an empty inner tube assembly being pumped or run into its latched position within the drill tube and core barrel.

The inner tube assembly may have a pair of components which move telescopically with respect to one another and are arranged such that the upwardly moving portion, which is attached to the inner tube, abuts against the release valve. Resilient means may be provided between the telescopic components which, at a pre-set pressure, will move to allow one of the portions to act against the release valve to thereby move the release valve axially to a position where it closes the fluid flow ports. As mentioned above, this is the indication, by way of an increase of pressure, that indicates to the operator, that the inner tube is full or blocked.

In addition to the core barrel being full, there are other circumstances such as a blockage in the inner tube or the bit being worn to such an extent that is expires and stops drilling. This will result in the release valve moving to a position where it closes the fluid flow ports. This fault in drilling again provides an indication to the driller that action needs to be taken.

A detailed description of one or more embodiments of the invention is provided below along with accompanying figures that illustrate by way of example the principles of the invention. While the invention is described in connection with such embodiments, it should be understood that the invention is not limited to any of the embodiments described. For the purpose of example, numerous specific details are set forth in the following description in order to provide thorough understanding of the present invention.

BRIEF DESCRIPTION OF DRAWINGS

A specific implementation of the present invention will now be described, by way of example only, and with reference to the accompanying drawings in which:

FIG. 2*b* is an enlarged section of FIG. 2*a*.

DETAILED DESCRIPTION OF PREFERRED EMBODIMENT OF THE INVENTION

Figure 1:
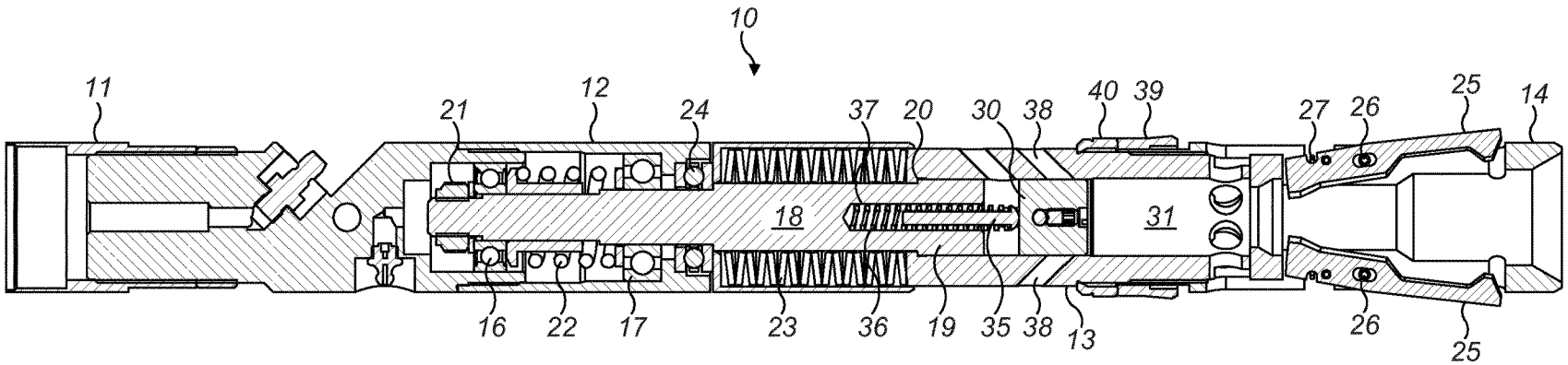
FIG. 1 shows a cross-section view of a head assembly incorporating a release valve.

FIG. 1 shows the cross section of a head assembly 10. It comprises an inner tube connector 11, a bearing housing 12, a valve housing 13 and a latch body 14. The head assembly 10 is connected to an inner tube (not shown) which receives the core sample. The inner tube is threadably connected to the inner tube connector 11. The inner tube and head assembly 10 together comprise the inner tube assembly.

The bearing housing 12 threadably engages to the inner tube connector 11 and houses a lower bearing 16 and an upper bearing 17. Journalled within and between the upper and lower bearings 16 and 17 is a spindle 18. The head end 19 of the spindle 18 is located within the valve housing 13. The head end 19 of the spindle 18 buts against shoulders 20 of the valve housing 13 and thereby acts to retain the valve housing 13 with respect to the bearing housing 12. A compression spring 22 acts on the end of a spindle 18 which in turn, via the spindle head 19 urges the valve housing 13 towards the bearing housing 12 and against compressible cup washers 23. A thrust bearing 24 is located within the bearing housing 12 and abuts against the end of the stack of cup washers 23. Tensioning nut 21 is used to adjust the compressive force applied by the compression spring 22 and the cup washers 23. This arrangement allows rotation of the inner tube connector 11 and bearing housing 12 with respect to the valve housing 13.

The latch body 14 is threadably engaged with the upper end of the valve housing 13. It includes a pair of latch arms 25 that are pivotally connected to the latch body 14 via pins 26. The upper end of each latch arm 25 is biased outwardly via an elastomeric ring 27 that is located around the lower end of each latch arm 25.

A release valve 30 having a general cylindrical body is journalled within an axial bore 31 within the valve housing 13. The release valve 30 has a guide pin 33 that locates within a guide slot 34 best seen in FIG. 2*c*. The release valve 30 abuts against a pin 35 mounted within a spring 36 and the spring 36 is located within an axial bore 37 within the spindle 18. The spring 36 acts to hold the pin 35 against the release valve 30.

Fluid flow port 38 extends from the axial bore 31 to the external surface of the valve housing 13. A fluid seal is formed between a flexible seal 39, a landing shoulder 40 and a landing ring (not shown) which is at the top of the outer tube (not shown) of a core barrel. Therefore, when the inner tube assembly is in its drilling position, drilling fluid which is pumped down the drill tube must then flow through the latch body 14 into the valve housing 13 and through the fluid flow ports 38 to then make its way to the drill bit between the inner tube and the outer tube of the core barrel. The drilling fluid then returns to the surface through the annulus formed by the wall of the hole being drilled and the outer surface of the drill string.

The inner tube assembly, which includes the head assembly 10, and the inner tube (not shown) attached to the inner tube connector 11 is designed to be both retrieved once the inner tube is full of core sample or blocked and also inserted within the drill tube after the inner tube assembly has been retrieved and the inner tube emptied. Depending on the orientation of the hole being drilled, the inner tube assembly can either be lowered by an overshot tool and wire line into its drilling position or alternatively pumped into its drilling position using fluid pressure. In some cases the density of the drilling fluid may be such that the core barrel assembly can free fall to its drilling position in a case of a vertical hole or near vertical hole. In a case of a vertical dry hole, where there is no fluid present within a drill string, then it may need to be lowered with the aid of an overshot tool and wire line from the surface. Conveniently, fluid pressure may also be used to drive the inner tube assembly into its drilling position. In the case of the current invention, this means that a column of water will have already filled the drill tube once the inner tube assembly reaches its drilling position (also referred to as latch position) whereupon drilling can commence immediately rather than having to wait for the drill tube to again then fill which may be the case if the drilling fluid is allowed to drain away.

Figure 2A:
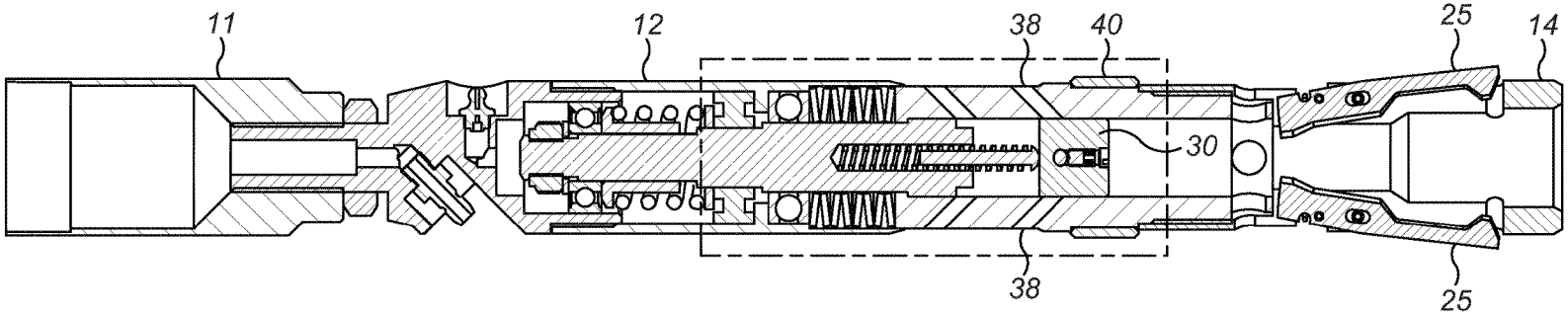
FIGS. 2*a* and 2*b* show a cross-section view of a head assembly with a release valve positioned for a pump-in position where
Figure 2C:
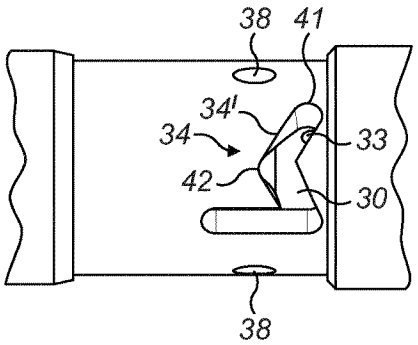
FIG. 2*c* shows the release valve and guide means for the release valve with the release valve shown in the pump-in position.
Figure 2B:
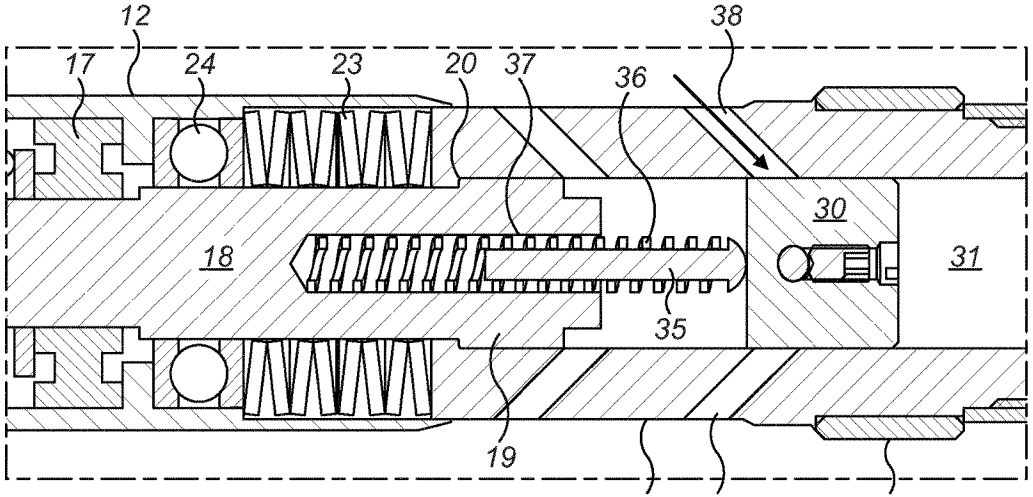

In the case of a horizontal hole, it will be necessary for the inner tube assembly to be pumped into its drilling position. FIGS. 2*a*, 2*b* and 2*c* show the release valve 30 positioned for the inner tube assembly to be pumped into the drilling position. In this position the release valve 30 closes the fluid flow ports 38. The landing shoulder 40 which includes the flexible seal 39 forms a sufficient fluid seal with the inner wall of the drill tubing (not shown) thereby preventing fluid from substantially bypassing the flexible seal 39 and the landing shoulder 40. Accordingly, with the release valve 30 in a position shown in FIGS. 2*a*, 2*b* and 2*c*, fluid pressure can be used to pump the inner tube assembly to its drilling position.

As seen in FIG. 2*c*, the guide pin 33 of the release valve 30 is located at the end 41 of the guide slot 34 (first position). The first portion 34', of guide slot 34 is angled with respect to the longitudinal axial of the valve housing 13 with the end 41 positioned upwardly with respect to the valve housing 13 and with the lower end 42 of slot 34' positioned forwardly of the upper end 41. In this position, the spring 36 of pin 35 is compressed so that the pin 35 pushes against the release valve 30 to hold the guide pin 33 in the upper end 41 of slot 34'.

The compressive strength supplied by the spring 36 is such that the fluid used to pump the inner tube assembly into its drilling position does not cause movement of the release valve 30 so that the fluid flow ports 38 remain closed during the pumping process. The release valve 30 remains in the position shown in FIGS. 2*a*, 2*b* and 2*c* as the inner tube assembly moves to its drilling position.

Figure 3A:
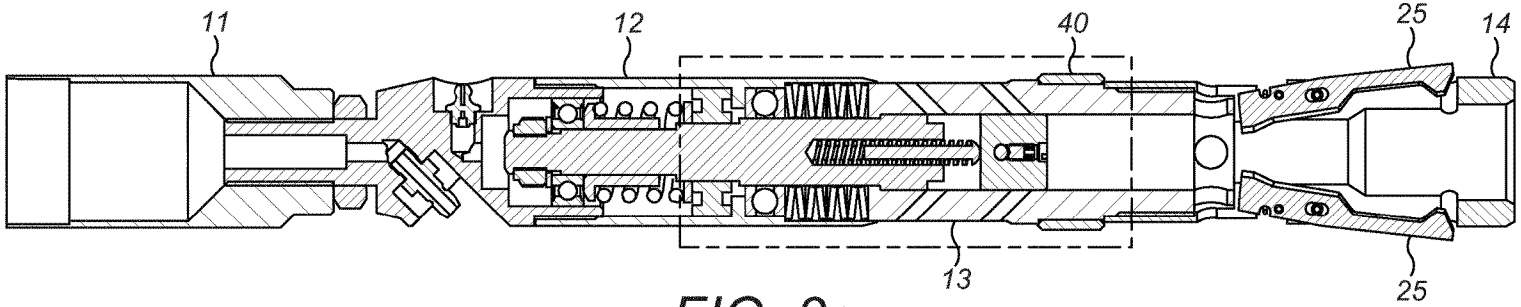
FIGS. 3*a* and 3*b* show cross-section views of a head assembly with the release valve in its second position.
Figure 3C:
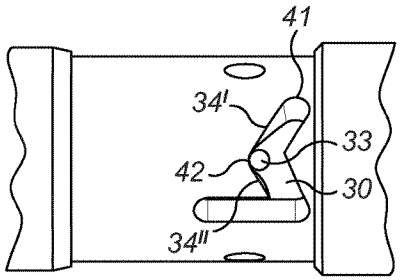
FIG. 3*c* shows the release valve and guide means where the release valve is in its second position.
Figure 3B:
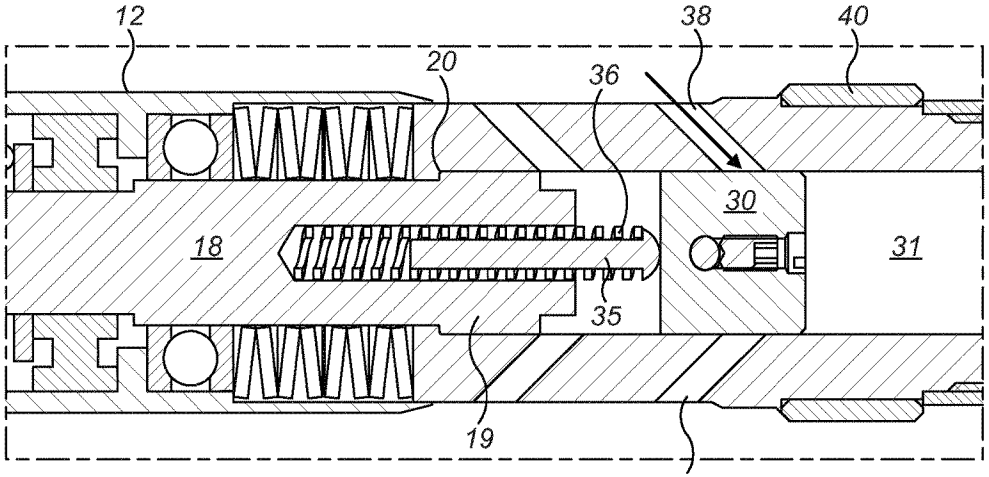

FIGS. 3*a*, 3*b* and 3*c* show the inner tube assembly in its drilling or latched position. When the landing shoulder 40 abuts against a landing ring movement of the inner tube assembly ceases and the latches 25 locate behind the locking coupling (not shown) on the core barrel above the outer tube (not shown). This locks the inner tube assembly with respect of the core barrel and as a result the inner tube assembly stops. This in turn results in the pumping fluid pressure spiking which gives an indication at the surface to the operator that the inner tube assembly is latched into its drilling position.

This increase in pressure is sufficient to move the release valve 30 into its second position as shown in FIG. 3*c*. This movement is controlled by the guide pin 33 and the guide slot 34 so that as the release valve 30 moves inwardly it is also rotated as the guide pin 33 moves along the first guide slot 34'. Once the guide pin 33 reaches the lower end 42 of slot 34' it is held in this position by fluid pressure. The second guide slot 34" is angled upwardly so that the first guide slot 34' and second slot 34" form a v shape with the lower end 42 at the base of each respective slot. Continued application of fluid pressure will therefore hold the release valve 30 in this position and maintain an indication of increased pressure to the surface operator. At the same time, as shown in FIGS. 3*a* and 3*b*, the release valve 30 keeps the fluid flow ports 38 closed. This means that the increase in fluid pressure will remain until the operator switches off the pump and opens a relief valve at the surface.

Figure 4A:
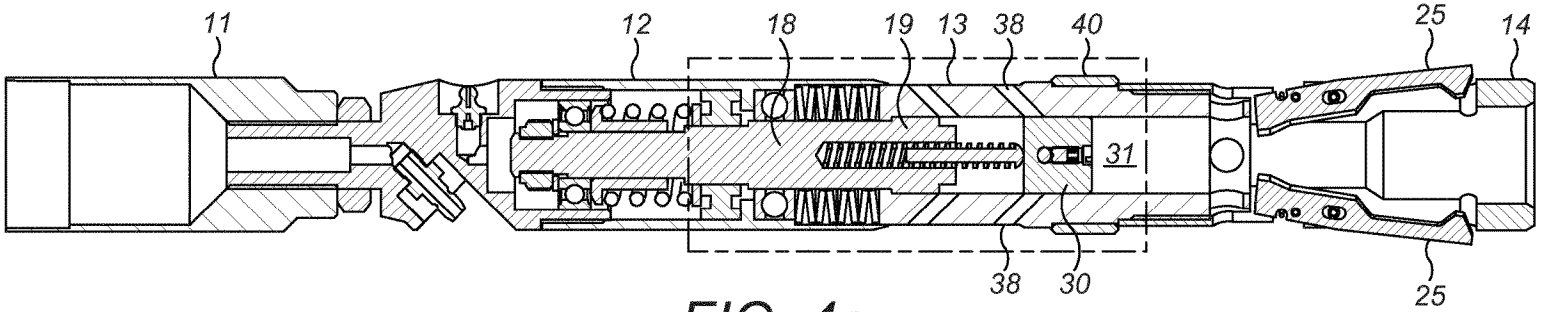
FIGS. 4*a* and 4*b* show cross-section views of a head assembly with the release valve in its third position.
Figure 4C:
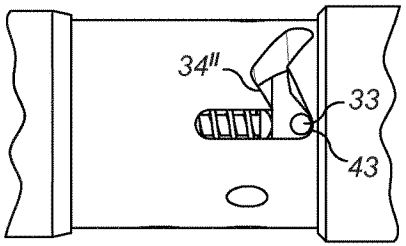
FIG. 4*c* shows the release valve and guide means for the release valve with the release valve in its third position.
Figure 4B:
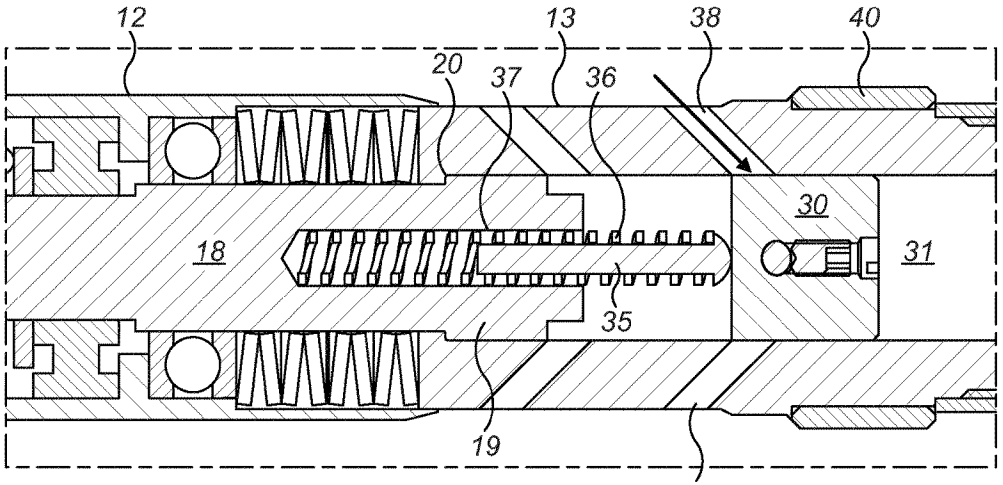

FIGS. 4*a*, 4*b* and 4*c* show the release valve 30 in its third position which follows from the fluid flow pump being turned off and a release valve at the surface being opened. With the fluid pressure above the release valve 30 reducing, the pin 35 and spring 36 push the release valve 30 into its third position. As shown in FIG. 4*c* the guide pin 33 has now moved to the upper end 43 of the second guide slot 34'''. Again, in this position, the release valve 30 keeps the fluid flow ports 38 closed. This maintained closure of the fluid flow ports 38 is important as it prevents the fluid in the drill string above the inner tube assembly from draining away. If the fluid flow ports 38 were open, in the case of horizontal hole or an upwardly inclined hole, or in the case of a dry hole, then the fluid column above the inner tube assembly will be free to drain away. As it takes some time at the surface to prepare the drill string to operate in its drilling mode, then this loss of fluid, which will have to be made up, will cause a delay in being able to commence the drilling operation. Commencing the drilling operation in the absence of any fluid flow past the drill bit is obviously undesirable and may result in overheating and burning of the cutting elements of the drill bit. Accordingly, by maintaining a fluid column within the drill string, then the drilling operation can commence with minimal delay.

Figure 5A:
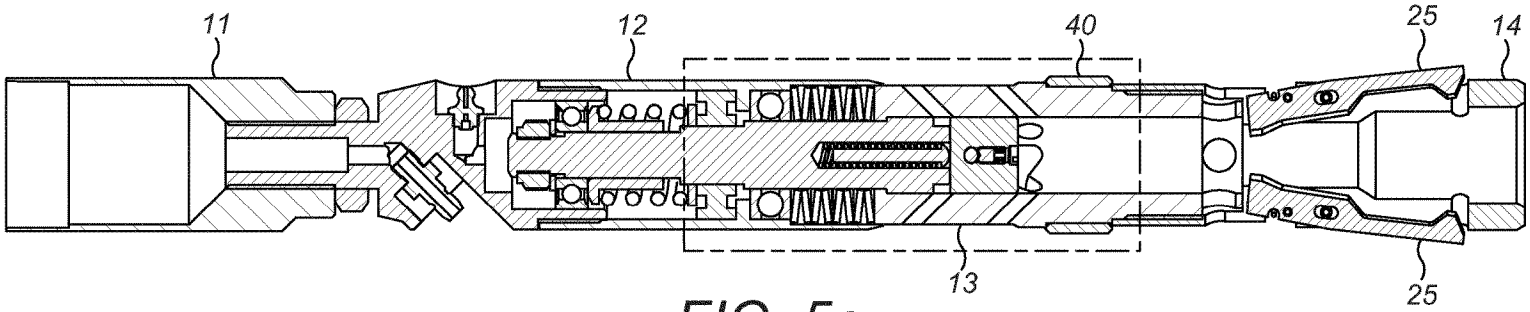
FIGS. 5*a* and 5*b* show cross-section views of the head assembly with the release valve in its fourth position.
Figure 5C:
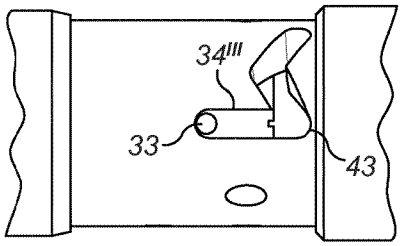
FIG. 5*c* shows the release valve and guide means where the release valve is in its fourth position.
Figure 5B:
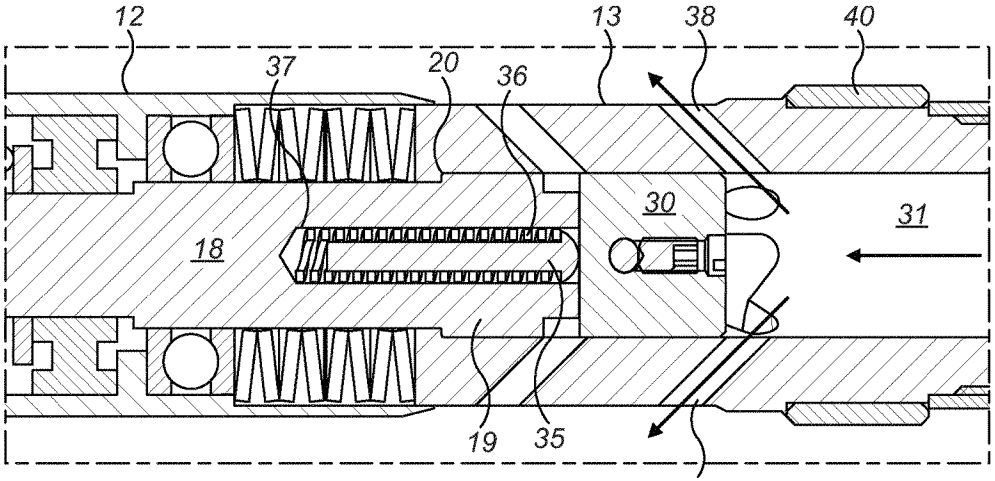

FIGS. 5*a*, 5*b* and 5*c* show the release valve 30 in its drilling position. In this embodiment, a fluid pressure of sufficient pressure is required to move the release valve 30 into its fourth position as shown in FIGS. 5*a*, 5*b* and 5*c*. This pumping pressure will overcome the force applied by the pin 35 and spring 36. As seen in FIG. 5*c*, the third guide slot 34''' extends parallel to the longitudinal axial of the head assembly 10 which in turn causes the release valve 30 to travel along the axial bore 31 so that it abuts against the head end 19 of the spindle 18. In this position the fluid flow ports 38 are open which allows drilling fluid to pass to the drill bit. The release valve 30 will be maintained in this open position provided the required fluid flow pressure is maintained. If for whatever reason the fluid flow pressure were to be interrupted or reduced then the release valve 30 would move axially again to upper end 43 of slot 34'''. This would mean that the release valve 30 was ready to move to its fourth open position as soon as fluid pressure was again applied.

Figure 6A:
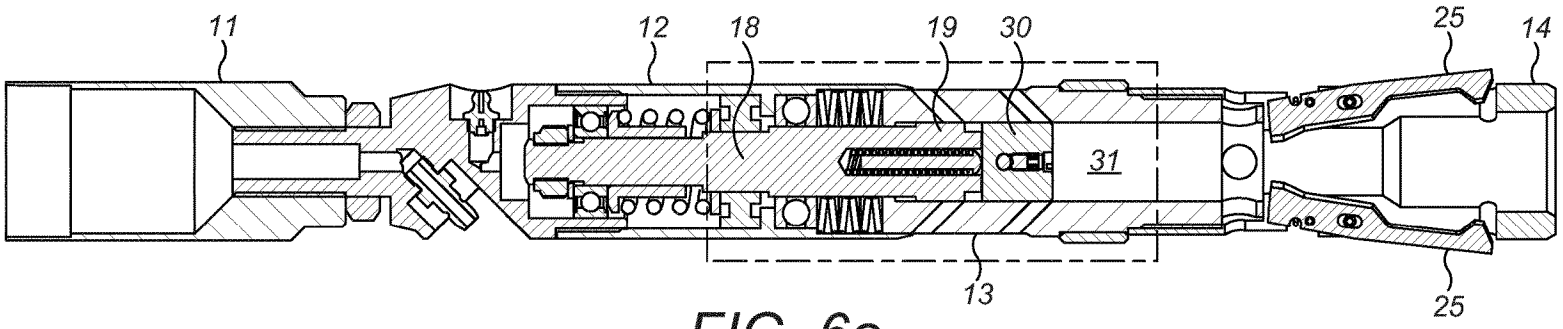
FIGS. 6*a* and 6*b* show cross-section views of a head assembly where a section of the head assembly has been moved by a full core barrel into a position where the release valve has been moved to close the fluid flow ports.
Figure 6C:
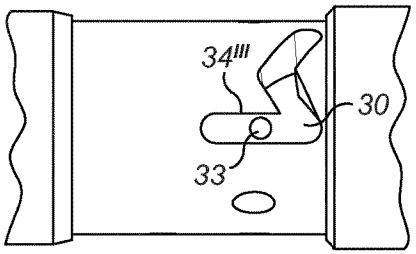
FIG. 6*c* shows the release valve and guide means with the release valve moved to a closed position as result of a full inner tube.
Figure 6B:
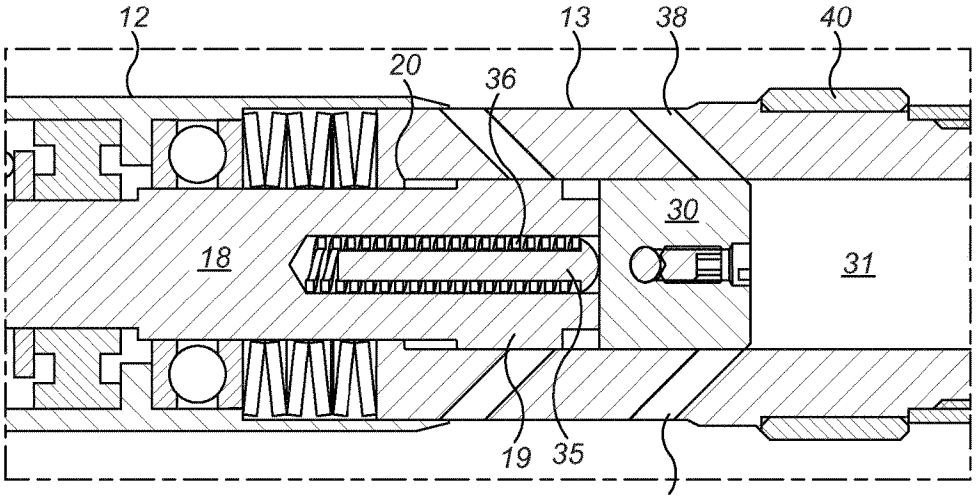

FIGS. 6*a*, 6*b* and 6*c* show relative movement between the bearing housing 12 and the valve housing 13 when a core sample blocks or fills the inner tube. When this occurs, continued advancement of the drill tube with respect to the bottom of the hole causes the core in the inner tube (or the inner tube in the case of a blockage) to push against the inner tube connection 11 and in turn push the bearing housing 12 with respect of the valve housing 13 so that cup washers 23 are caused to compress. This in turn results in the head 19 of the spindle 18 moving axially within the axial bore 31. The release valve 30 which is abutting against the head end 19 of the spindle 18, is in turn is moved within the axial bore 31 to a point where the release valve 30 will again close the fluid flow ports 38. This in turn results in a spike in the fluid pressure which is sensed at surface by the operator. The operator knows that the inner tube is full or that there is a problem and that the inner tube assembly needs retrieval. The operator then commences the sequence of retrieving the inner tube assembly which involves the use of an overshot tool to latch with the latch body 14. The action of the overshot tool (not shown) is to close the latch to release the inner tube assembly from the core barrel while at the same time positively engaging the latch body 14 so that the inner tube assembly can be retrieved to the surface.

Prior to retrieval of the inner tube assembly, the drill string and drill are lifted from the bottom of the hole which acts to break the core sample from the hole being drilled in the conventional way. Upon lifting of the drill string from the bottom of the hole, pressure on the inner tube which caused relative movement between the bearing housing 12 and the valve housing 13 is relieved. This will then result in the relaxing of the cup washers 23 which will in turn retract the head 19 of the spindle 18 acting to push the release valve 30 to a position where it closes the fluid flow ports 38. In this position, the force exerted by spring 36 and the pin 35 against the release valve 30 may not be sufficient to hold back the force applied by the column of water in the drill tube. If this is the case, then the release valve 30 will move to an open position and allow the column of fluid to drain from the drill tube. This will be the case if it is a vertical or near vertical dry hole. Once the drill string is lifted from the bottom of the hole, the wire line attached to an overshot tool can then be used to retrieve the inner tube barrel assembly.

Figure 8A:
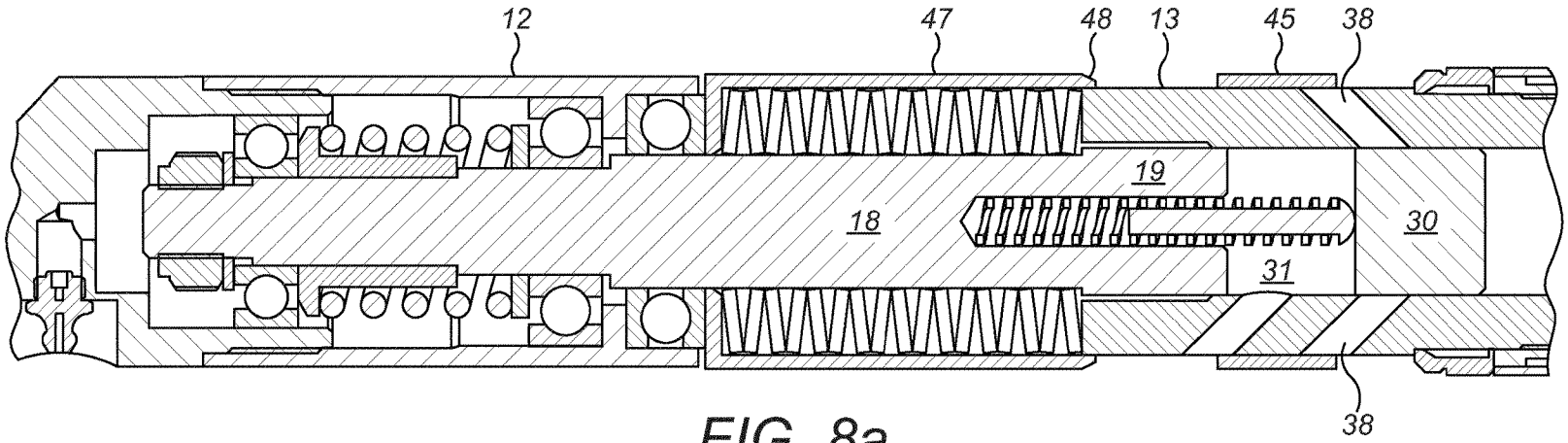
FIGS. 8 (*a* and *b*) to 12 (*a* and *b*) show a second embodiment of the means for controlling movement of the release valve 30 which comprises a collar that locates around the outer surface of the valve housing.

A second embodiment of the release valve 30 is illustrated in FIGS. 8 (*a* and *b*) to 12 (*a* and *b*) and show an arrangement where the head 19 of the spindle 18 is threadably engaged within the axial bore 31. This provides a more rigid connection between the valve housing 13 and the bearing housing 12. However, this now means that the spindle 18 will not move with respect to the valve housing 13 when the inner tube is full or blocked and therefore the head 19 of the spindle 18 will not move the abutted release valve 30 when in its drilling position to close the fluid flow ports 38.

Figure 8B:
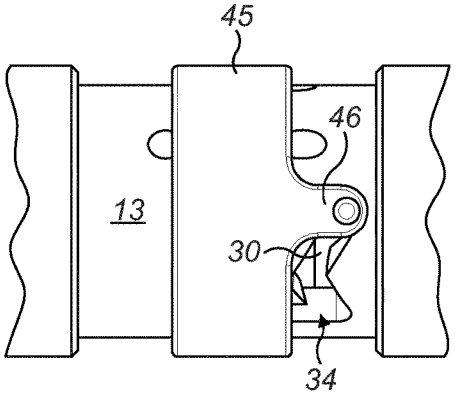
Figure 9A:
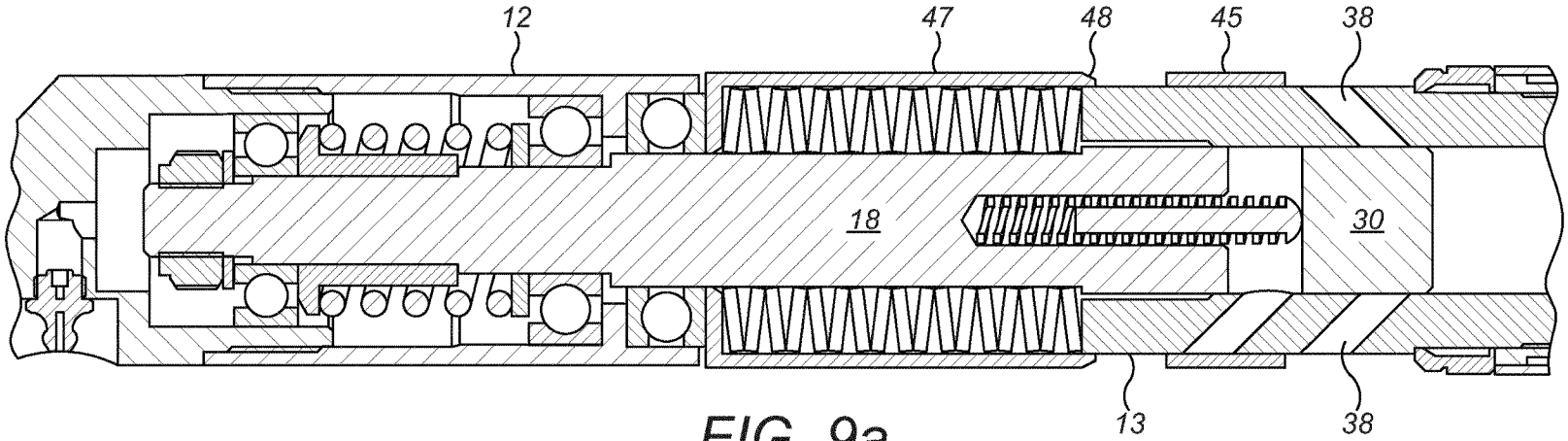
Figure 9B:
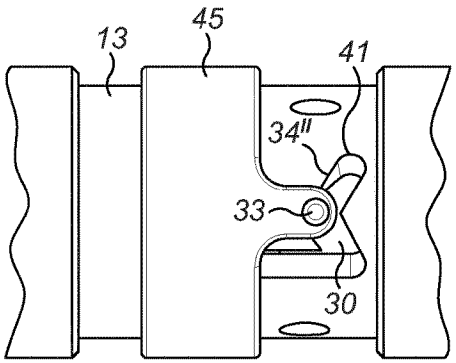
Figure 10A:
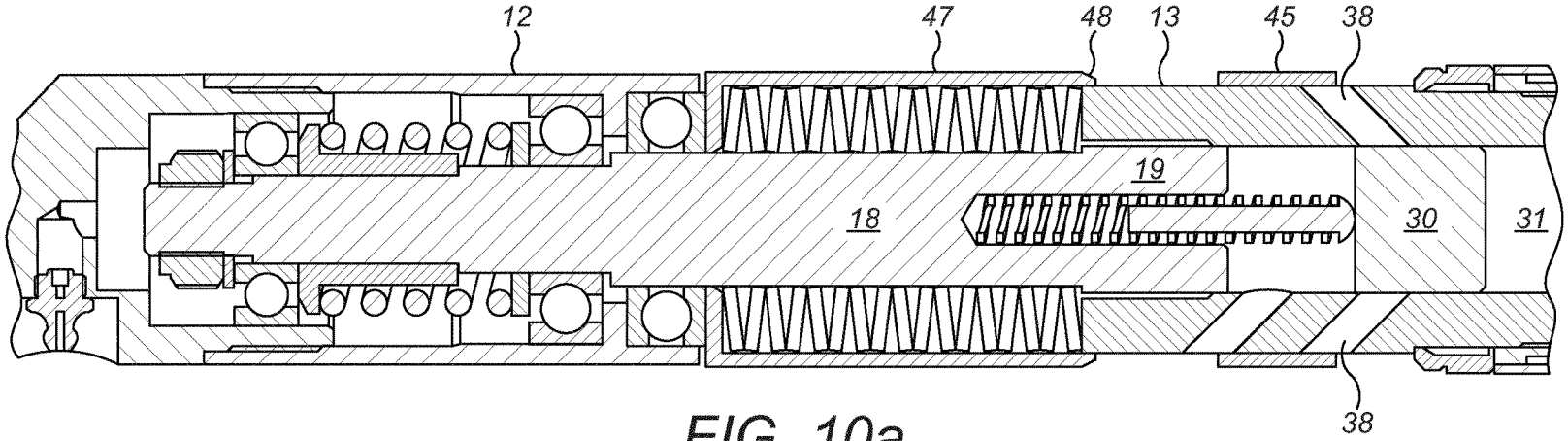
Figure 10B:
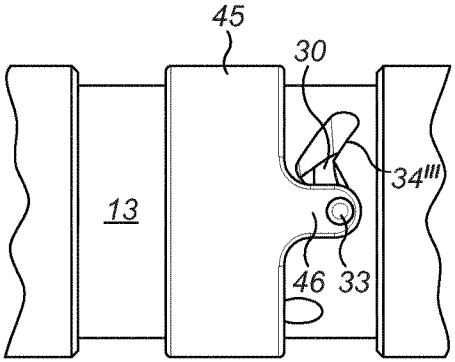

As seen in FIG. 8*b*, a collar 45 is now located on the external surface of the valve housing 13 and has tabs 46 that connect to the pin 35. In this embodiment, a pair of diametrically opposed guide slots 34 may be provided in the valve housing 13 and likewise a pair of pins 33 are mounted to the release valve 30. The tabs 46 are secured respectively to the pins 33. The collar 45 has a sliding fit on the outer surface of the valve housing 13 and therefore moves freely as the release valve 30 moves in the axial bore 31. The collar 45 will both move longitudinally with respect to the valve housing 13 as well as rotate as the pin 33 of the release valve 30 moves within the guide slots 34.

Figure 11A:
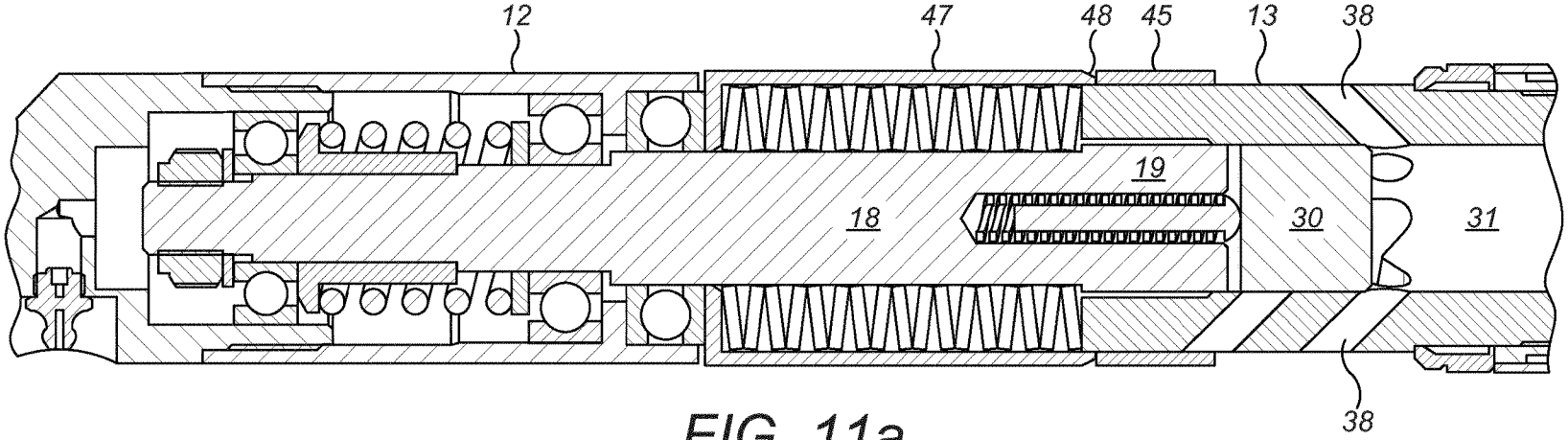
Figure 11B:
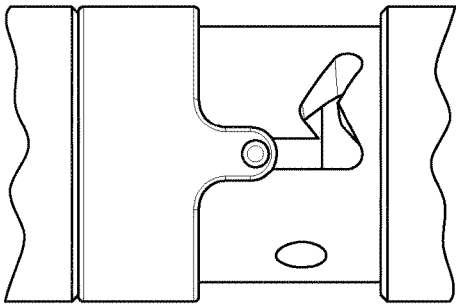
Figure 12A:
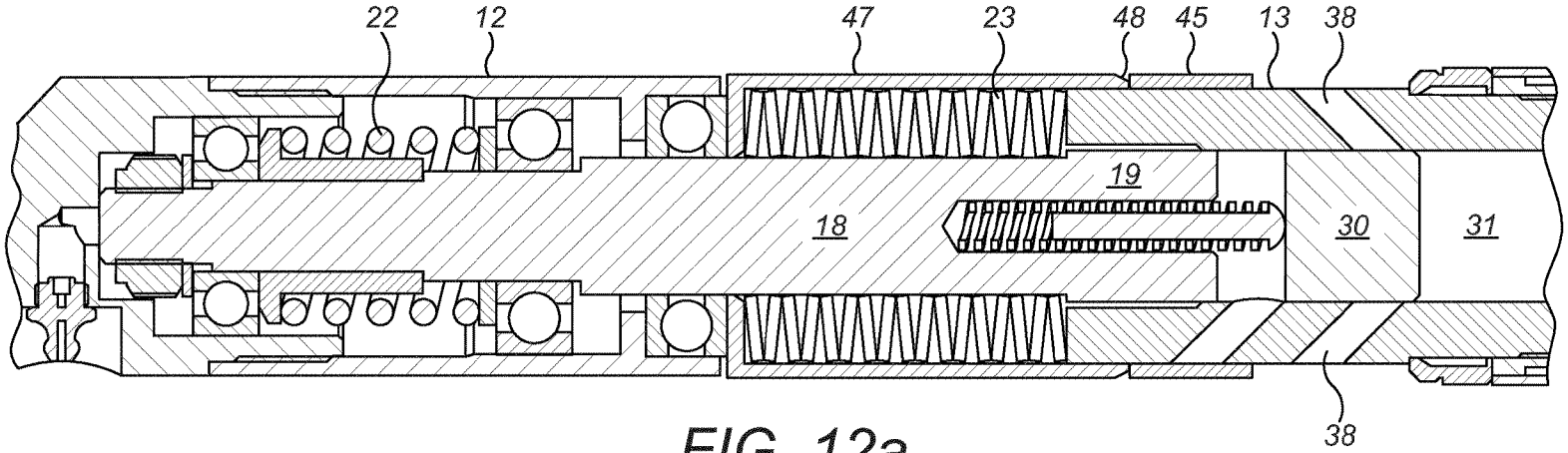
Figure 12B:
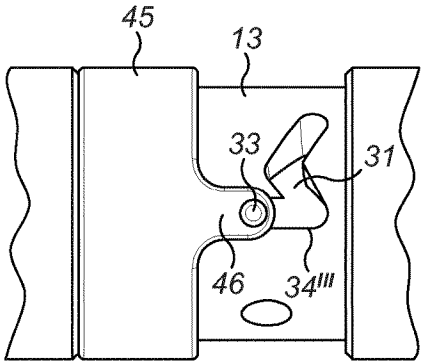

The operation of the release valve 30 as seen in FIGS. 8 (*a* and *b*) to FIGS. 11 (*a* and *b*) will be the same as that described above. However, as seen in FIGS. 12*a* and 12*b*, when the inner tube is full or there is a blockage, and the bearing housing 12 moves upwardly with respect to the valve housing 13, the spindle 18, due to the head 19 being threadably engaged with the valve housing 13 will remain fixed with respect to the valve housing 13 so that the bearing housing 12 will move upwardly with respect to the spindle 18. This in turn causes compression of the spring 22 due to movement of the upper bearing 17 within the bearing housing 12. At the same time, the housing 47 within which the cup washers 23 are located will move upwardly with respect to the valve housing 13. In turn, the end 48 of the housing 47 will abut against the collar 45 which in turn will move the collar 45, and the attached guide pins 33 and release valve 30 upwardly within the axial bore 31 to close the fluid flow ports 38. Accordingly, the release valve 30 will act to prevent drilling fluid flow and therefore provide an indication that the inner tube is full or blocked.

As can been seen from the above description, the release valve 30 used in these embodiments provide significant advantage over a conventional known system in that the release valve 30 will maintain a water column within the drill tube after the inner tube assembly has latched into its drilling position. The release valve 30 also provides an advantage in indicating when the inner tube is full by comparison to known systems. In known systems the shut off valve comprise elastomeric rings that are compressed that expand against the inner wall of the drill tube. Although this system is proven satisfactory overtime, the release valve as described herein provides a useful alternative which the inventors believe is an improvement over previously known systems.

Figure 7:
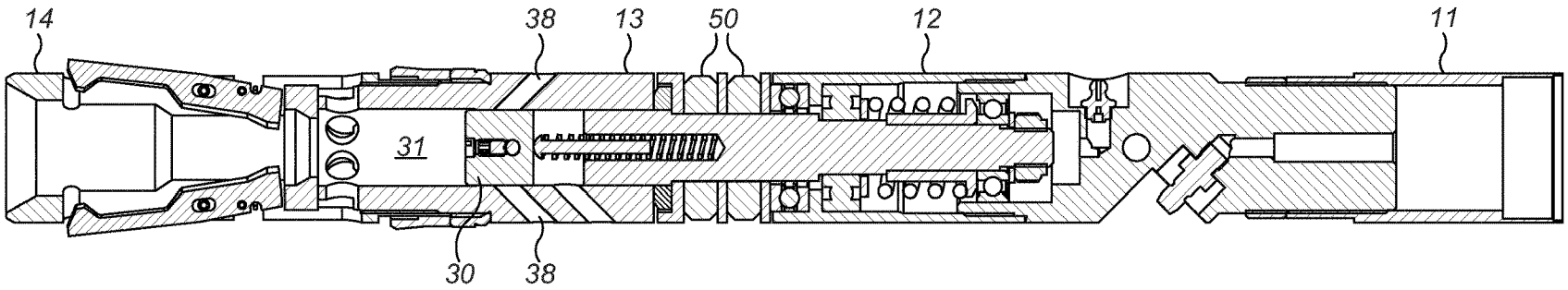
FIG. 7 shows a cross-section of a head assembly using elastomeric rings to block fluid flow when the core barrel is full.

Alternatively, instead of the spindle head 19 of the spindle 18 being pushing against the release valve 30 when the inner tube is full to move the release valve 30 to close the fluid flow ports 38, the head assembly 10 may include the elastomeric rings 50 which are compressed to seal the hole to provide the pressure indication that the inner tube is full. This arrangement is shown in FIG. 7.

It will also be apparent to person skilled in the art that the inner tube assembly described above, and in particular the latching arrangement, facilitate the use of a single set of tools being overshot assemblies and inner tube assemblies that can be used in a variety of different types of holes which are either wet or dry and a variety of hole having different inclinations from vertically down to vertically up and every position in between. This is due to the inner tube assembly being able to be either pumped in or lowered using an overshot tool and also the same overshot tool being capable of being pumped in or lowered to latch with the inner tube assembly. This will be a significant advantage to drillers who prior to this invention we required to carry multiple sets of tools for different types of holes. This invention provides therefore a unified set of tools which can be used in any type of hole.

It will be appreciated by those skilled in the art that the invention is not restricted in is use to the particular invention described. Neither is the present invention restricted in its preferred embodiment with regard to the particular elements and/or features described or depicted herein. It will be appreciated that the invention is not limited to the embodiment or embodiments disclosed, but is capable of numerous rearrangements, modification and substituents without departing from the scope of the invention.

The invention claimed is:

1. An inner tube assembly releasably latchable within a core barrel of a core drilling apparatus, the inner tube assembly comprising:

a valve housing having a first leading end and a second trailing end, the housing defining an internal bore extending axially in a direction between the first and second ends;

at least one fluid flow port provided through the valve housing to allow fluid communication with a region surrounding the valve housing and the bore;

a valve body axially slidable within the bore to open and close the port;

a bearing assembly coupled to the first end of the valve housing, at least a part of the bearing assembly being movable axially relative to the valve housing to close and open the port;

an elongate spindle extending axially between the valve housing and the bearing assembly, the bearing assembly including a bearing housing extending axially over the spindle;

a collar slidably mounted around a region of the valve housing in a vicinity of the port;

a bias member acting on the valve body to bias the valve body in a first axial direction within the bore; and a position guide having a guide pin and being arranged to guide and control a position of the valve body within the bore relative to the port, the collar being connected to the valve body via the guide pin and configured to open and close the port via abutment with the bearing housing, wherein the valve body is configured for movement in a second return axial direction within the bore to open and close the port by a fluid pressure acting on the valve body via the second end of the housing.

2. The assembly as claimed in claim 1, further comprising a valve pin mounted to be capable of axial movement within the bore to contact the valve body, the bias member being configured to bias the pin into contact with the valve body.

3. The assembly as claimed in claim 1, wherein the position guide includes a slot provided in the housing, the guide pin extending radially from the valve body to be movable within the slot.

4. The assembly as claimed in claim 3, wherein the slot includes a length having an angled section, the guide pin being capable of moving along the length and passed the angle section.

5. The assembly as claimed in claim 4, wherein the angled section has a v-shaped profile.

6. The assembly as claimed in claim 1, wherein the spindle is configured to move axially within the bore to contact and force the valve body to move in the first axial direction to open and close the port.

7. The assembly as claimed in claim 6, wherein the spindle is rigidly connected to the valve housing and the bearing housing is configured to slide axially relative to the valve housing to open and close the port at a radially external side of the port.

8. The assembly as claimed in claim 6, further comprising a bias component mounting the spindle within the bearing assembly to bias axial movement of the bearing housing or the spindle relative to the valve housing.

9. The assembly as claimed in claim 1, further comprising a latch provided at or towards the second end of the valve housing to releasably latch the inner tube assembly in substantially fixed position within the core barrel.

10. A method of controlling a flow of a working fluid within a drilling apparatus comprising:

providing an inner tube assembly, the inner tube assembly including a valve housing having a first leading end and a second trailing end, the housing defining an internal bore extending axially in a direction between the first and second ends; at least one fluid flow port provided through the valve housing to allow fluid communication with a region surrounding the valve housing and the bore; a valve body axially slidable within the bore to open and close the port; a bearing assembly coupled to the first end of the valve housing, at least a part of the bearing assembly being movable axially relative to the valve housing to close and open the port; an elongate spindle extending axially between the valve housing and the bearing assembly, the bearing assembly including a bearing housing extending axially over the spindle; a collar slidably mounted around a region of the valve housing in a vicinity of the port; a bias member acting on the valve body to bias the valve body in a first axial direction within the bore; and a position guide having a guide pin and being arranged to guide and control a position of the valve body within the bore relative to the port, the collar being connected to the valve body via the guide pin and configured to open and close the port via abutment with the bearing housing;

operating the valve body within an inner tube assembly to maintain the fluid flow port of the assembly in a closed position to allow pressure of the fluid to push the inner tube assembly to a latched position within a core barrel of the drilling apparatus:

i) while the pressure of the fluid is applied to push the inner tube assembly into the latched position;

ii) when the inner tube assembly reaches the latched position; and iii) while the inner tube assembly is latched and a pressure of the fluid is released for a first time;

applying a further pressure of the fluid to move the valve body to an open position to allow the fluid to flow through the inner tube assembly during drilling operation; and forcing movement of the valve body in a second return axial direction within the bore of the valve housing by the application of the pressure of the fluid onto the valve body via the second trailing end of the valve housing.

11. The method as claimed in claim 10, further comprising biasing the valve body to close the port by applying a pressure of the fluid that is less than the biasing force on the valve body i) while the inner tube assembly is pushed towards the latched position, ii) when the inner tube assembly reaches the latched position and iii) while the inner tube assembly is latched and a pressure of the fluid is released for the first time.

* * * * *